United States Patent [19]

Banks

[11] 4,254,758

[45] Mar. 10, 1981

[54] VORTEX HEAT RECLAIMING SYSTEM

[76] Inventor: George W. Banks, 24824 43rd Ave. So., Kent, Wash. 98031

[21] Appl. No.: 67,217

[22] Filed: Aug. 17, 1979

[51] Int. Cl.[3] ..... F24B 9/00; F04D 29/58

[52] U.S. Cl. ..... 126/247; 122/26; 165/122; 165/140; 237/55; 415/179; 417/243

[58] Field of Search ..... 126/247; 165/125, DIG. 12, 165/122, 140; 415/178, 179; 122/26; 417/243; 237/55

[56] References Cited

U.S. PATENT DOCUMENTS

| | | | |
|---|---|---|---|
| 3,048,006 | 8/1962 | Goodman | 415/179 |
| 3,245,399 | 4/1966 | Lawson | 126/247 |
| 3,297,019 | 1/1967 | Lawson | 126/247 |
| 3,402,702 | 9/1968 | Love | 126/247 |
| 3,481,322 | 12/1969 | Hokanson, Sr. et al. | 126/247 |
| 3,640,646 | 2/1972 | Horbnschuch et al. | 417/243 |
| 3,773,106 | 11/1973 | Levy | 165/125 |
| 3,835,918 | 9/1974 | Pilarczyk | 415/179 |
| 3,866,668 | 2/1975 | Doerner | 165/125 |

FOREIGN PATENT DOCUMENTS

| | | | |
|---|---|---|---|
| 2541715 | 4/1976 | Fed. Rep. of Germany | 417/243 |
| 26184 | of 1907 | United Kingdom | 415/179 |

*Primary Examiner*—Sheldon Richter

[57] ABSTRACT

With this improved system the final gas discharge temperature can be one hundred degrees lower than the water it heated.

Two high velocity, self pressurized vortexes are created by two high speed impeller wheels, one in each stage of the two-stage heat reclaiming system, these vortexes draw the heat carrying discharge gas from the furnace into the two-stage heat exchanger, compressing and compounding it, creating higher heat levels, which allows more wasted heat to be recovered and used. The heat exchanging surfaces of the system are scrubbed by the maximum heat and pressure of these vortexes which have a velocity of many thousands of feet per minute, this action increases the thermal conductivity of these surfaces over 3.5 times, heating the water hotter and cooling the gas faster than the conventional system. This cooled gas is then forced out through the flow control discharge orifice, the discharge pressure being high, the flow control discharge orifice is inherently small which effectively closes the chimney when the furnace and the vortex drive are simultaneously shut off. All of the power consumed by the two impeller wheels is converted into useable heat.

8 Claims, 4 Drawing Figures

VORTEX HEAT RECLAIMING SYSTEM

This invention relates to the general field of reclaiming the vast amounts of lost heat escaping up furnace chimneys. To simplify and clearly illustrate the new features of the improved system, I am describing a two-stage system being used on a domestic hot air heating system.

The principal object of this present invention is to triple the recovery of lost heat and convey it to places where heat is most needed.

A further object is to create temperatures which can be readily used at a profit.

A further object is to make a smaller, more efficient heat reclaiming system to conserve energy.

A further object is to reduce the cost of recovering lost heat.

A further object is to effectively close the chimney allowing only the pilot fumes to escape to the chimney when the furnace is off.

A further object is to provide the proper flow through the furnace for top performance regardless of the chimney draft.

A further object is to allow the furnace to start only when the proper flow to the chimney has been established.

A further object is to provide a positive pressure in the house by having a heated fresh air intake which blocks out the cold air which otherwise comes in around doors, windows and other places.

A further object is to make the furnace heat more stable, the lost heat being stored in water continues to heat in vital places during the interval the furnace is off.

DETAILED DESCRIPTION

Figure 2:
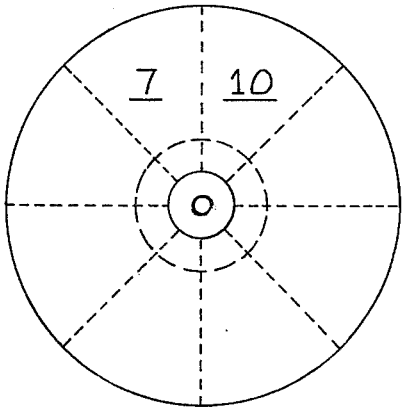
FIG. 2 is a cross-sectional view of the impeller wheels.
Figure 1:
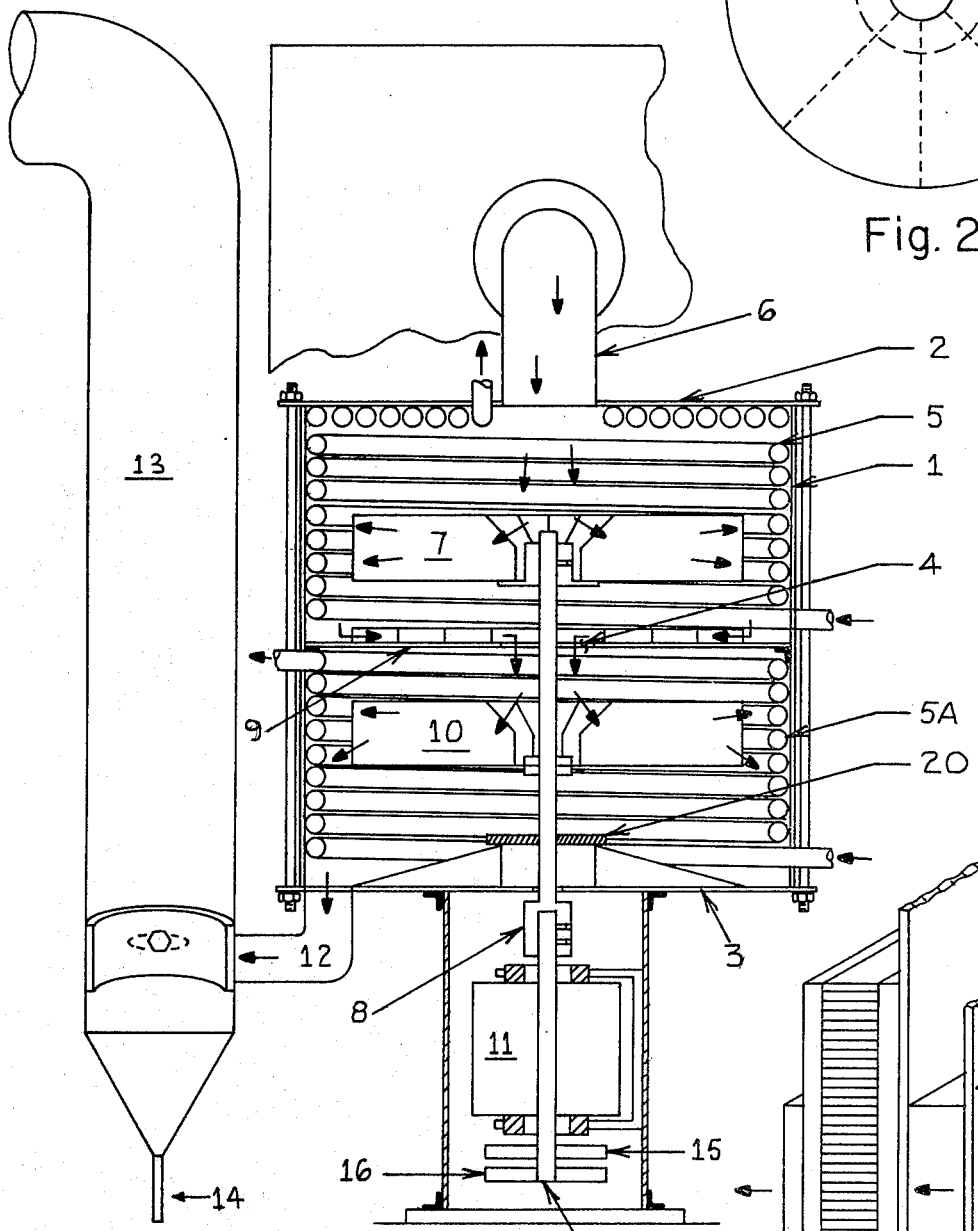
FIG. 1 is a vertical section showing the two-stage system.
Figure 3:
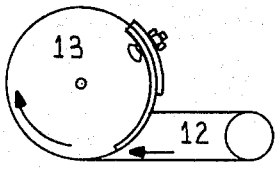
FIG. 3 is a cross-sectional view of the discharge stack.
Figure 4:
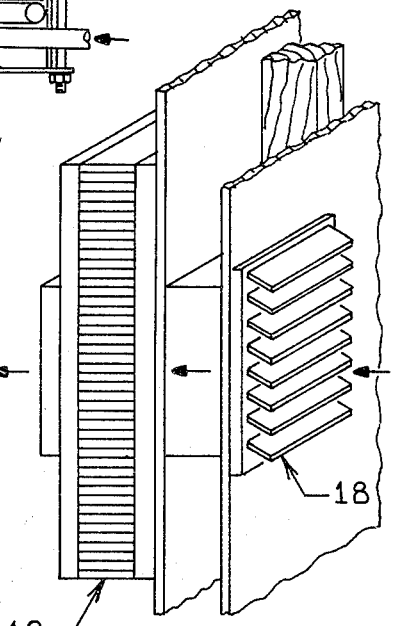
FIG. 4 is a perspective view of a radiator placed in an outside air intake.

This combination of elements employed in creating this new high velocity vortex heat reclaiming system is both unique and ingenious. As illutrated in the accompanying, Vertical Section drawing, this system employs two mechanically created high velocity vortexes, one in each stage of a two-stage apparatus having a housing in the shape of an upright hollow cylinder 1 having a top cover 2 and a bottom cover 3. The first stage is located in the upper part of the hollow closed cylinder and the first stage water is circulated in coils of tubing 5 attached to and substantially covering the inside walls and the inside top cover of the first stage. The lower second stage is separated from the first stage by a stator stage separator 9. The water in the second stage is circulated in coils of tubing 5-A attached to and substantially covering the inside walls of the second stage. Each stage having ample space for a high speed horizontal impeller wheel 7 and 10.

The heat carrying discharge gas from the furnace is drawn into the top center intake 6 of the first stage by a high velocity gas vortex which is created by a horizontal impeller wheel 7 held in the upper central portion of the first stage and driven by the extended drive shaft 8 of a motor 11 concentrically rubber mounted on the outside of the bottom cover 3. This high velocity vortex pressurizes the incoming gas which raises the temperature and scrubbs the surfaces of the first stage tubing 5 with a velocity of thousands of feet per minute and the maximum heat and pressure of the vortex.

This action heats the water in the tubing 5 hotter and faster than in the conventional heat exchanger, due to the fact that this scrubbing action increases the thermal conductivity of these heat exchanging surfaces over 3.5 times.

The pressure of the first stage vortex and the suction of the second stage vortex forces the cooled gas into the stator stage separator 9 and channels the gas into the center intake 4 of the second stage. The second stage high velocity vortex is created by a second horizontal impeller wheel 10 held in the upper central portion of the second stage and driven by the same extended drive shaft 8. This long extended drive shaft 8 being carried by the concentrically located rubber mounted motor. 11 allows the high speed impeller wheels 7 and 10 to spin freely and quietly without vibration on a dynamic axis which is created by the combined dynamic balance of the two high speed impeller wheels 7 and 10 thus eliminating the necessity of additional bearings which would cause vibration, noise, excessive wear, additional cost and a difficult lubrication problem. Number 20 is a flexible moving seal.

This second stage vortex compounds the pressure of the first stage with the pressure of the second stage, doubling the pressure and raising the cooled gas temperature, then the maximum heat, pressure and velocity of this gas vortex scrubs the coils of tubing 5-A in the second stage, heating the water and recovering more heat before the cooled gas is forced out through the flow control orifice 12. The flow control orifice 12 is adjustable, and the discharge pressure being high and stable makes it possible to readily attain the proper flow for a wide range of furnaces, regardless of chimney draft.

The discharge pressure being high, the flow control discharge orifice is inherently small which effectively closes the chimney when the furnace, the furnace fan and the motor are simultatively shut off.

The high discharge gas pressure from the flow control discharge orifice 12 is directed into and around the inside perimeter of the large vertical discharge stack 13, the upper end connected to the chimney. This high pressure creates a high velocity horizontal vortex in the stack 13, this vortex makes an efficient liquid separator, the gas now cool is saturated with drops of moisture, the vortex causes the moisture to collect on the inside walls and run down and out through a small drain 14 in the closed bottom end of the vertical stack 13, this gives dry and still cooler discharge gas to the chimney.

The water in each stage is kept separate and is circulated by two centrifugal water pumps 15 and 16, one above the other and mounted on the lower end of the motor 11 and driven by the lower end of the drive shaft 17. The lower pump 16 circulates the high temperature water from the first stage through high temperature radiators placed under windows, and other places where heat is most needed. The upper pump 15 circulates the cooler water from the second stage through a radiator 19 placed in an outside air intake 18, this radiator 19 heats the incoming cold air to around 75 degrees before it is drawn into the cold air return of the furnace, this heated fresh air blocks out incoming cold air which would otherwise come in around doors, windows and other places.

Having thus disclosed my invention, I claim:

1. An improved heat reclaiming apparatus comprising in combination a housing means for defining a closed space for each of two high velocity, heat carrying gas vortexes, each of said vortexes accomplishing heat reclaiming functions at different heat and pressure levels, said housing means in the shape of an upright hollow cylinder having a top and a bottom cover and a horizontal double walled stage separating stator dividing said hollow cylinder into two spaces, the upper space being the first stage and the lower space being the second stage, said housing means having a top center gas intake channeling said gas into the eye of the first stage vortex, said gas then flows to the outer perimeter of said first stage vortex where it is forced into said stator which channels it into the eye of the second stage vortex, said gas then flows to the outer perimeter of said second stage vortex where it is forced out through the flow control orifice, the heat exchange surfaces of said stages are water carrying coils of tubing attached to and substantially covering the inside walls of said stages, a high speed impeller wheel driven by and held in the upper central position of each of said stages by the extended drive shaft of a motor, concentrically rubber mounted on the outside of said bottom cover, said second stage impeller wheel doubling the pressure of said first stage, the flow control orifice of said second stage is considerably smaller than the low pressure intake of said first stage.

2. An apparatus according to claim 1 in which said two high speed impeller wheels are mounted on said long extended drive shaft of said concentrically rubber mounted motor allowing said impeller wheels to spin freely and quietly without vibration on a dynamic axis created by the combined dynamic balance of said high speed impeller wheels.

3. An apparatus according to claim 1 in which the second stage pressure being high the flow control orifice is inherently small effectively closing the chimney when the apparatus is shut off.

4. An apparatus according to claim 1 in which the contact points of a pressure switch are placed in the control circuit of the furnace, said pressure switch being actuated by the pressure of said second stage, said points making contact and allowing said furnace to start only when the proper pressure and flow has been established.

5. An apparatus according to claim 1 in which said discharge flow control orifice directs the high pressure discharge gas into and around the inside perimeter of a large vertical discharge stack connected to the chimney, said high pressure gas creates a high velocity horizontal vortex in said stack causing the moisture in said gas to collect on the inside walls and run down and out through a small drain in the otherwise closed bottom end of said vertical stack.

6. An apparatus according to claim 1 in which two centrifugal pumps are mounted one below the other on the lower end of said motor and are driven by the lower drive shaft of said motor, the lower pump circulates the high temperature, first stage heated water through a high temperature radiator placed where heat is most needed and the upper pump circulates the lower temperature second stage heated water through a lower temperature radiator placed in an outside air intake relieving the negative pressure in the bulding.

7. An apparatus according to claim 1 in which said flow control discharge orifice is adjustable allowing one heat reclaiming apparatus to provide the proper flow for a wider range of furnaces.

8. An apparatus according to claim 1 in which said vortexes have a velocity of thousands of feet per minute, said heat exchange surfaces are scrubbed by the maximum heat, pressure and velocity of said vortexes thereby increasing the thermal conductivity of said surfaces many times.

* * * * *